US006994403B2

(12) United States Patent
York

(10) Patent No.: US 6,994,403 B2
(45) Date of Patent: Feb. 7, 2006

(54) APPARATUS AND METHOD FOR REMOVING FLOOR TILE

(76) Inventor: Jack Martin York, P.O. Box 5625, McAllen, TX (US) 78502

( * ) Notice: Subject to any disclaimer, the term of this patent is extended or adjusted under 35 U.S.C. 154(b) by 1 day.

(21) Appl. No.: 11/025,527

(22) Filed: Dec. 30, 2004

(65) Prior Publication Data

US 2005/0151413 A1 Jul. 14, 2005

Related U.S. Application Data

(63) Continuation-in-part of application No. 10/712,602, filed on Nov. 12, 2003, now abandoned.

(51) Int. Cl.
*B60R 21/02* (2006.01)
*E21C 25/10* (2006.01)

(52) U.S. Cl. ..... 299/95; 52/749.11

(58) Field of Classification Search ..... 299/36.1, 299/37.3, 95, 15; 254/43, 95, 73; 414/11; 52/749.11

See application file for complete search history.

(56) References Cited

U.S. PATENT DOCUMENTS

| | | | | | |
|---|---|---|---|---|---|
| 1,619,091 | A | * | 3/1927 | Rieser | 33/454 |
| 3,224,346 | A | * | 12/1965 | Simonson et al. | 264/31 |
| 3,815,890 | A | * | 6/1974 | Urban | 269/43 |
| 3,909,056 | A | * | 9/1975 | Duwe | 294/67.22 |
| 5,000,890 | A | * | 3/1991 | DiStefano et al. | 264/35 |
| 5,010,647 | A | * | 4/1991 | Gray | 30/169 |
| 5,713,637 | A | * | 2/1998 | Worden et al. | 299/37.1 |
| 6,027,174 | A | * | 2/2000 | Gerbasi | 299/14 |
| 6,047,520 | A | * | 4/2000 | Caraballo | 52/49.11 |
| 6,523,906 | B1 | * | 2/2003 | Holder | 299/36.1 |

* cited by examiner

*Primary Examiner*—John Kreck

(57) ABSTRACT

An apparatus and a method that is used to mechanically remove flooring tiles intact from the foundation and then after the foundation and tile surfaces have been prepared, the same tile is reset undamaged.

10 Claims, 9 Drawing Sheets

APPARATUS AND METHOD FOR REMOVING FLOOR TILE

This application is a continuation-in-part of application Ser. No. 10/712,602, filed Nov. 12, 2003, now abandoned.

BACKGROUND—FIELD OF INVENTION

The apparatus generally relates to grouted ceramic, marble, stone, or porcelain flooring tiles that have separated in part from the underlying foundation for the purpose of resetting them properly. The apparatus also relates to removing fully set tiles to be used in other areas of a floor for the purpose of replacing cracked tiles or tiles that cannot be repaired.

BACKGROUND—DESCRIPTION OF PRIOR ART

Repair of grouted flooring tiles that have separated from the base structure is currently done by chipping or cutting out the surrounding grout first. Second the tile must be pried out using a chisel hammered under the tile however, chances are good that the tile will crack at or near where the prying force on the chisel was applied. If the job is successful then the tile and underlying structure are properly cleaned and the old tile is reset using a thin-set mortar or other comparable adhesive. If the tile cracks during the procedure then a new tile must be substituted. The problem is that if the new tile does not match the surrounding tile floor then the appearance of the floor is greatly diminished. Separation can occur because of a shift in the foundation, poor application of thin-set mortar, or a lack in the expansion joints. If a separated tile is not repaired then it will crack with time and normal use.

Prior art attempted to solve this problem of repairing separated tiles in two ways. The first was injecting an adhesive under the tile through a drilled hole illustrated by DiStefano U.S. Pat. No. 5,000,890. This method does address salvaging the original tile but there are three problems with this method. First, the equipment required for the job is expensive. Second, the machines are complicated to operate for an ordinary person making this method of repair only available to an experienced technician. Third, the injected adhesive may not be able to penetrate and flow into all of the hollow spaces between the tile and the foundation to provide adequate and proper setting of the tile. If the adhesive injection is still unsuccessful then removing the tile intact by conventional methods will be near impossible and would have to be chipped out in pieces. The end result to the consumer is a higher cost and less than a high probability of success and in a worst case scenario leaving only a destructive method of tile removal and replacement with a new tile.

The alternative is to forgo any repair of an individual tile and instead remove the separated tile in pieces and replace it with a new one. The first of the destructive methods to remove the tile uses a torch to crack the tile then remove the pieces and is illustrated by Gerbasi U.S. Pat. No. 6,027,174. The second is to use a mechanized chipper to break the tile and is illustrated by Holder U.S. Pat. No. 6,523,906 and Worden U.S. Pat. No. 5,713,637.

OBJECTS AND ADVANTAGES

Some of the objects and advantages over prior art of the apparatus are as follows:

(a) to recover the separated tile intact so that it can be reset properly;

(b) to minimize the cost to the consumer by allowing one not skilled the art to accomplish the job on his own due to the lower threshold of expertise and equipment required for the job over an adhesive injection method;

(c) to provide a viable alternative to destructive method repairs;

(d) to provide an apparatus and method to more reliably recover a separated tile over the current tile removal technique utilizing hammer and chisel type hand tools.

(e) to recover a fully set tile in a closed room like a closet to replace a cracked or damaged tile in an open room like a hallway when both rooms have identical tile.

DRAWING FIGURES

Figure 7:
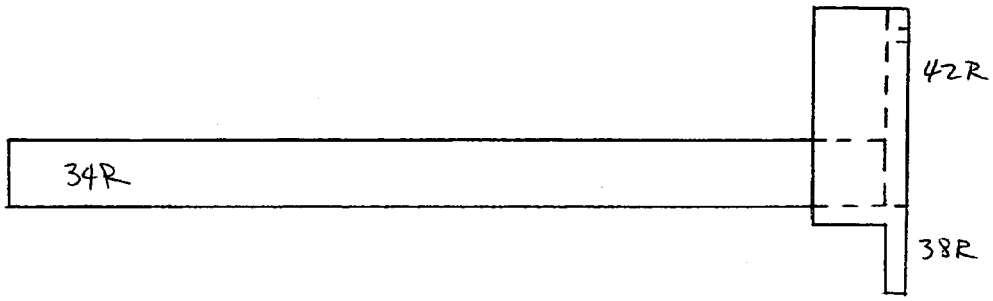
FIG. 7 is a right side view of the clamp guide rod and tile clamp and tile clamp riser.
Figure 7A:
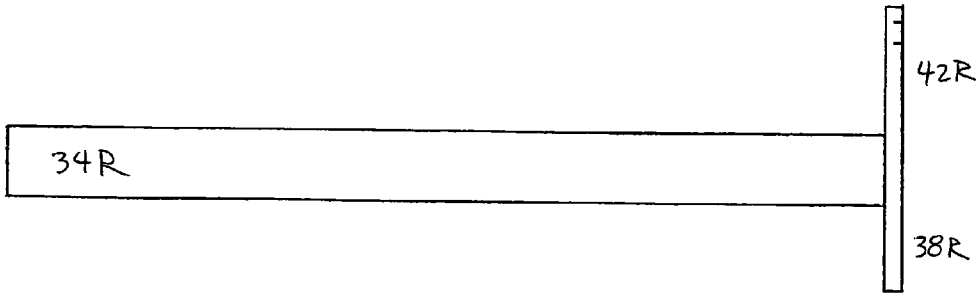

FIG. 7*a* is a right side view of clamp guide rods, tile clamps and tile clamp risers using flat bar material instead of angle iron.

Figure 8:
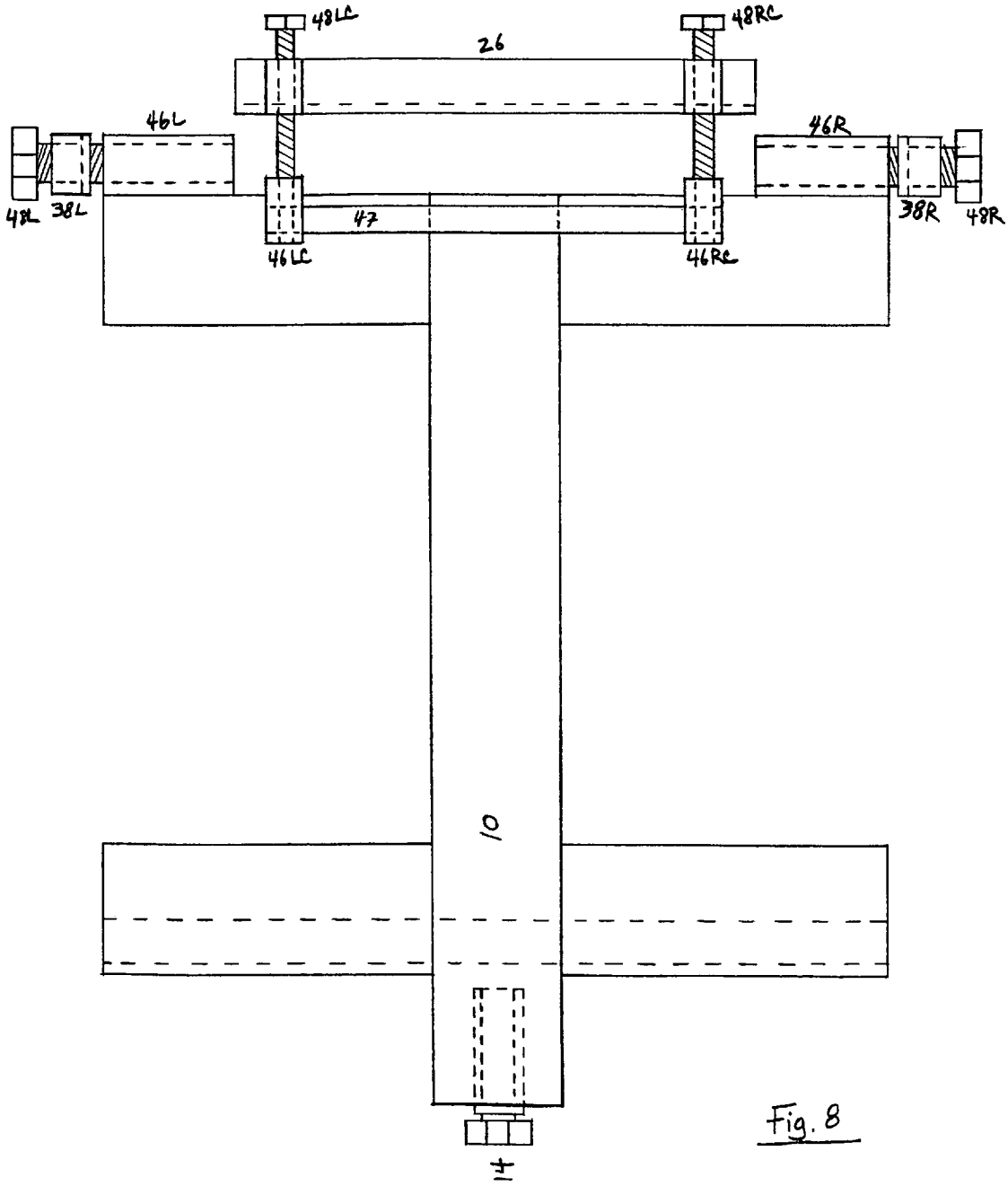

FIG. 8 is a top view of another embodiment showing a simpler version with fewer parts.

Figure 9:
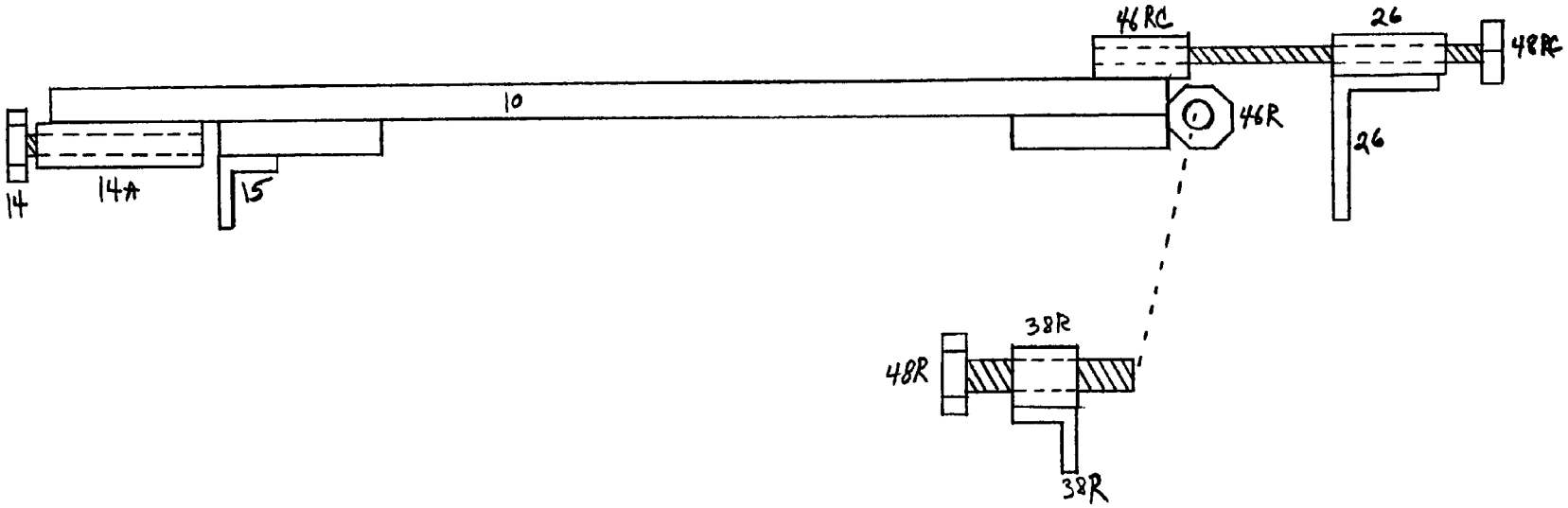

FIG. 9 is a side view of the embodiment from FIG. 8

REFERENCE NUMERALS IN DRAWINGS

| | |
|---|---|
| 10 | base plate |
| 10A | base plate |
| 10B | base plate |
| 14 | base tang |
| 15 | base cleat clamp |
| 18R | spring lug |
| 18C | spring lug |
| 18L | spring lug |
| 22 | spring |
| 26 | tension clamp |
| 30 | clamp guide tube |
| 34R | clamp guide rod |
| 34L | clamp guide rod |
| 38R | tile clamp |
| 38L | tile clamp |
| 42R | tile clamp riser |
| 42L | tile clamp riser |
| 46R | width adjustment nut |
| 46RC | tension clamp nut |
| 46L | width adjustment nut |
| 46LC | tension clamp nut |
| 47 | tension clamp nut support |
| 48R | tile clamp bolt |
| 48RC | tension clamp bolt |
| 48L | tile clamp bolt |
| 48LC | tension clamp bolt |
| 50R | width-adjustment nut support |
| 50L | width-adjustment nut support |
| 54 | tile |
| 58 | adjustment plate |

-continued

| | |
|---|---|
| 62A | adjustment bolt |
| 62B | adjustment bolt |
| 66A | length adjustment nut |
| 66B | length adjustment nut |
| 70R | lock nut |
| 70L | lock nut |
| 75 | circular abrasive blade saw or drill |

SUMMARY

To recap, the apparatus is designed to remove a partially separated flooring tile intact so that the original tile can be reset properly. The apparatus is also designed to remove a fully set tile so it can be used in another area of a floor for the purpose of replacing a cracked tile or a tile that cannot be repaired.

DESCRIPTION—FIGS. 1–9

Figure 1:
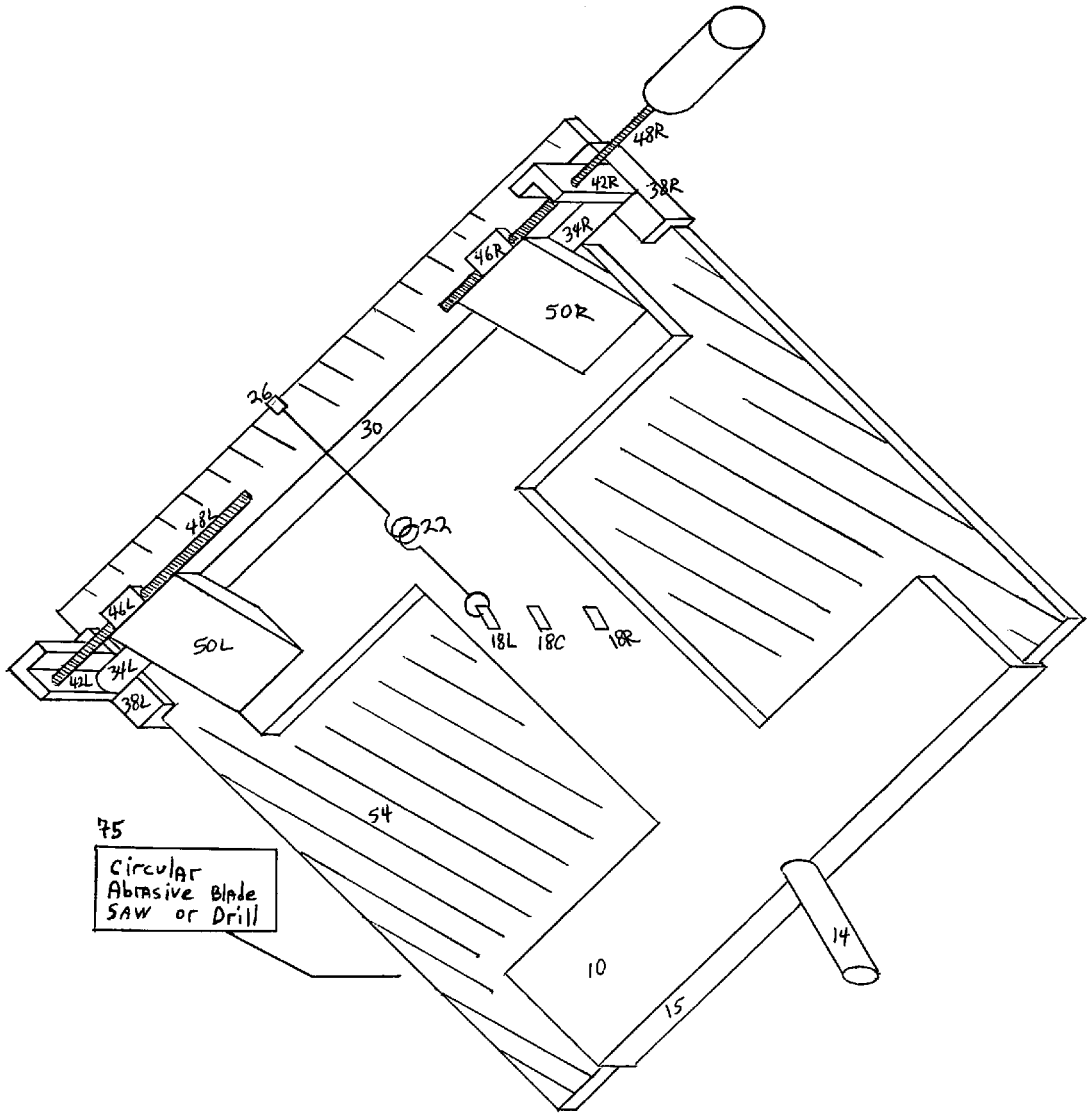
FIG. 1 is an isometric view not including hidden lines. The hidden lines were omitted here to minimize clutter.
Figure 2:
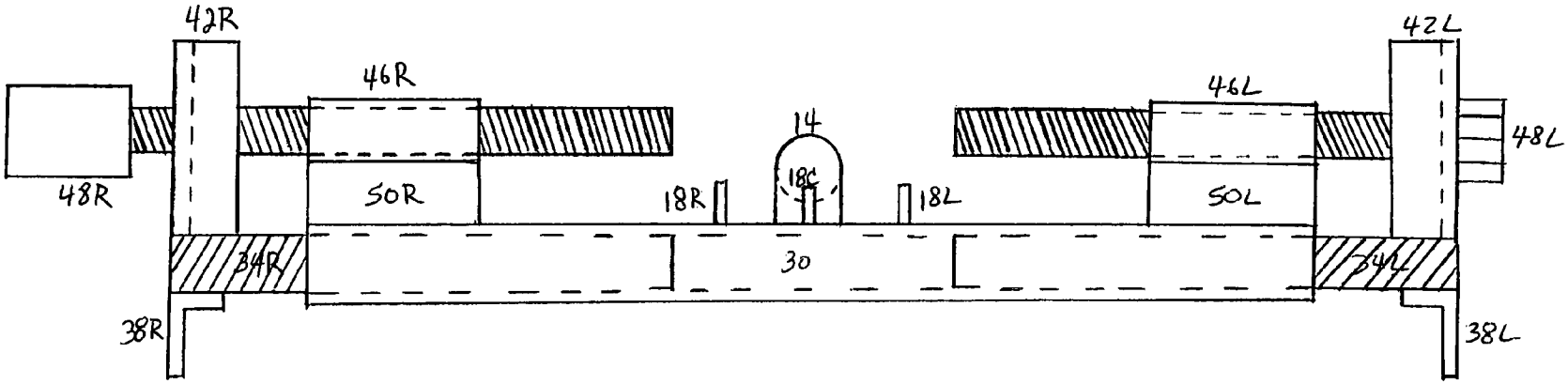
FIG. 2 is a front view from the position of the tile clamps.
Figure 3:
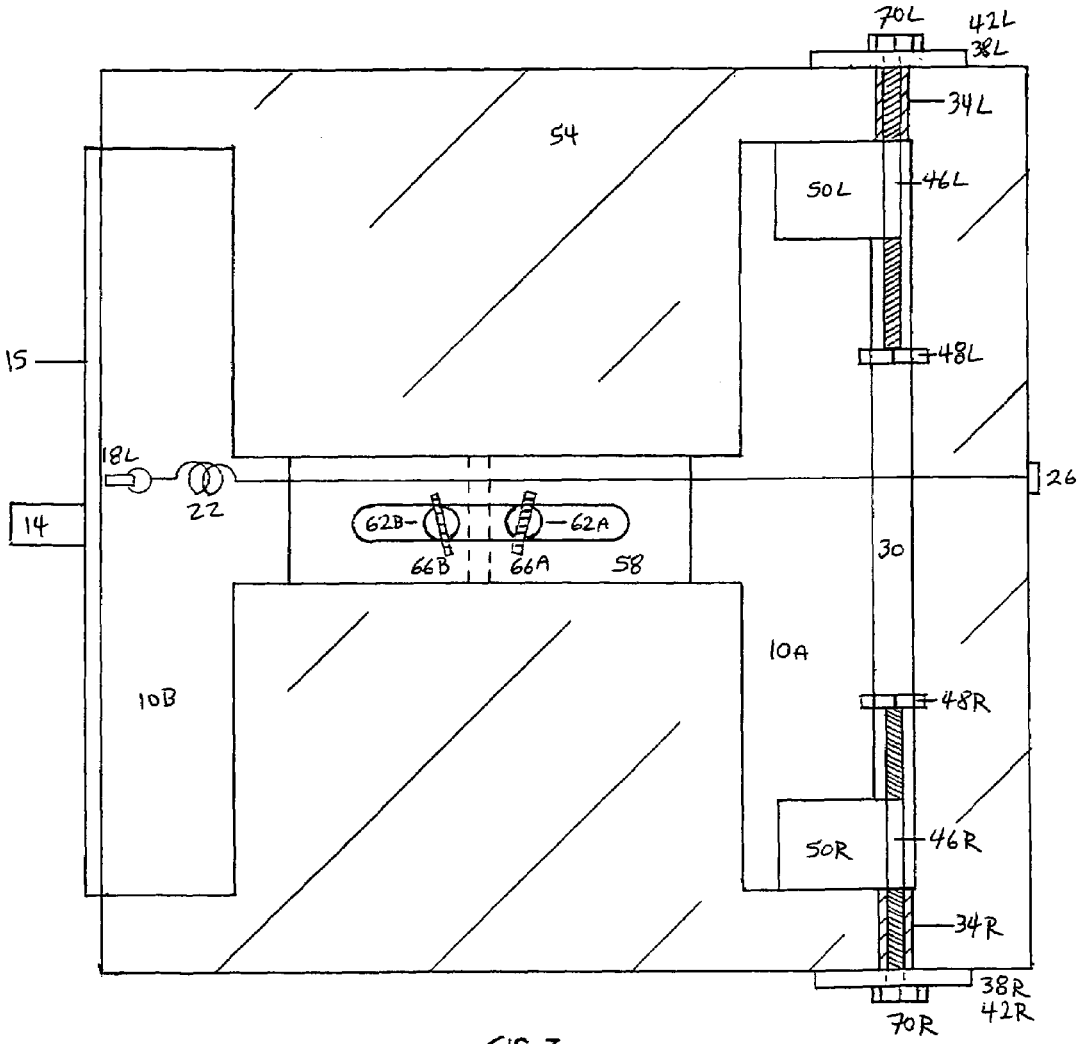
FIG. 3 is another embodiment using a top view showing length adjustability of the apparatus.
Figure 4:
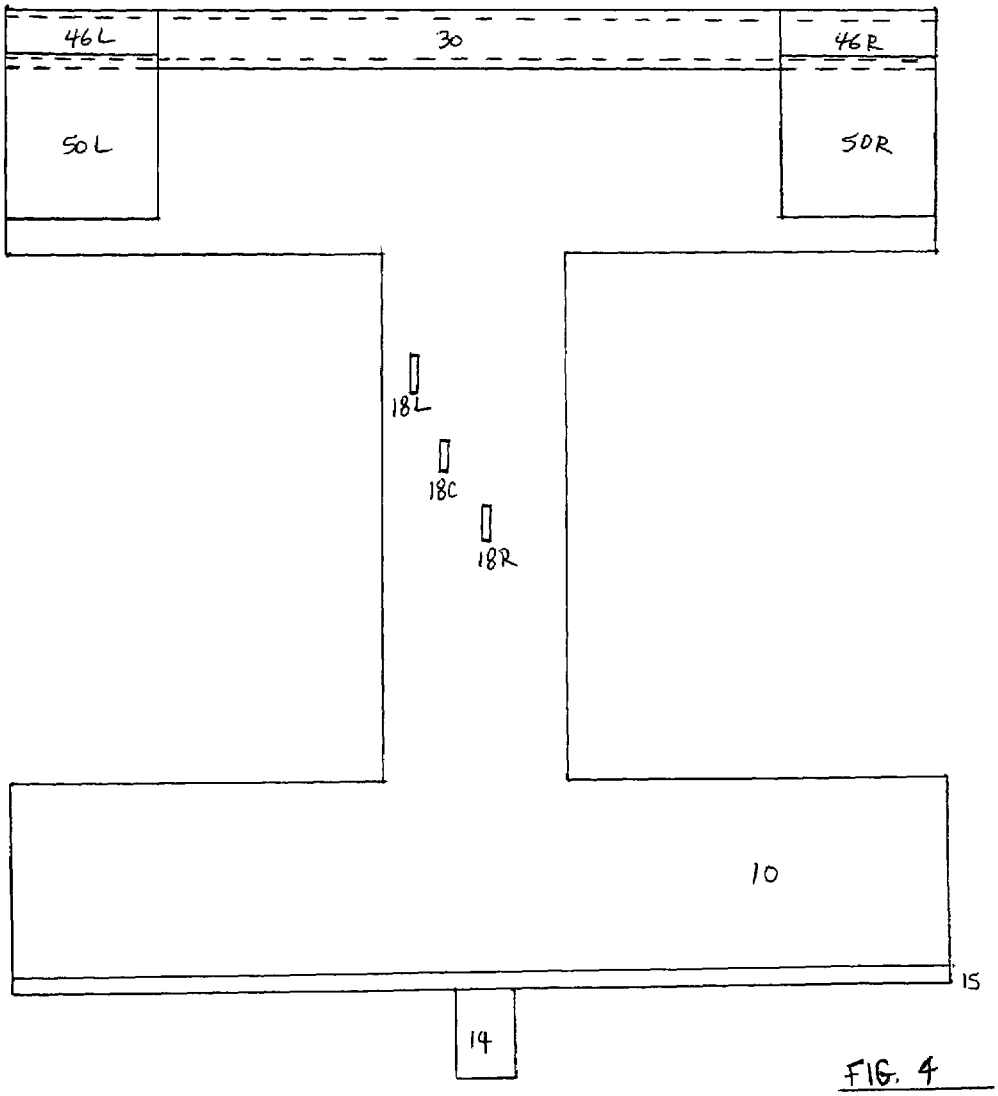
FIG. 4 is a top view of the base plate only.

A typical embodiment of the apparatus is illustrated in FIG. 1, and an alternate embodiment is shown in FIG. 3 using different material, a reversal in one component, and another adjustable component. Another embodiment is shown in FIG. 8 which is a simplified version.

The entire structure is made of a rigid material usually steel. A base plate 10 can be made of welded pieces of steel or solid cut from plate material. The "I" shape was chosen to reduce weight and improve aesthetics of the apparatus. The rear of the apparatus is comprised of a base cleat clamp 15 and a base tang 14 as shown in FIGS. 1, 3, 4, 5,. Base cleat clamp 15 and base tang 14 are attached to base plate 10.

Figure 5:
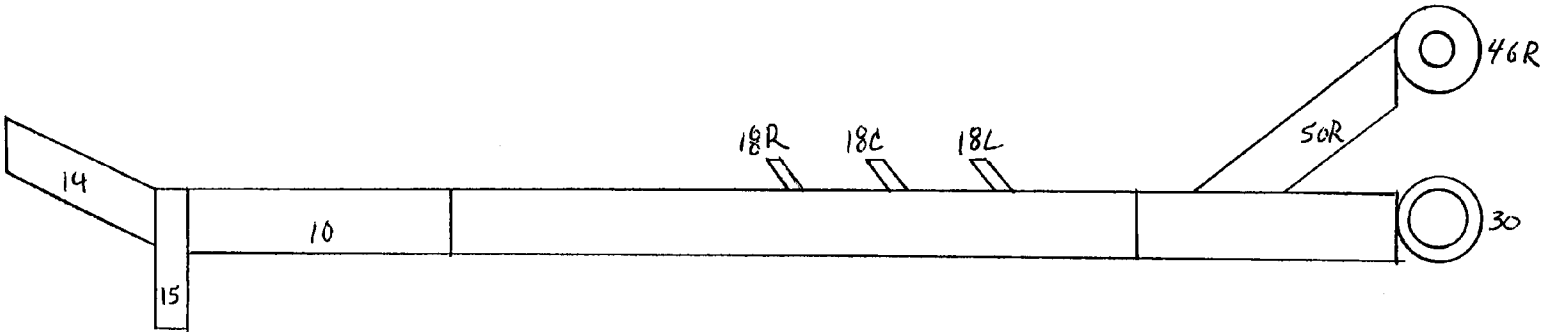
FIG. 5 is a right side view of the base plate only.

A spring lug 18L, a spring lug 18C and a spring lug 18R are attached to base plate 10 at different intervals and at different distances from front of base plate 10 as shown in FIGS. 1, 3, 5. The purpose of spring lugs 18L, 18C and 18R are to act as an attachment for a spring 22. A tension clamp 26 attaches to tile 54, near front of base plate 10, which in turn attaches to spring 22 which in turn attaches to one of the spring lugs 18L, 18C or 18R depending on the amount of tension needed. This tension or pressure minimizes the chance of chipping or cracking tile 54 during the hammering process.

Figure 6:
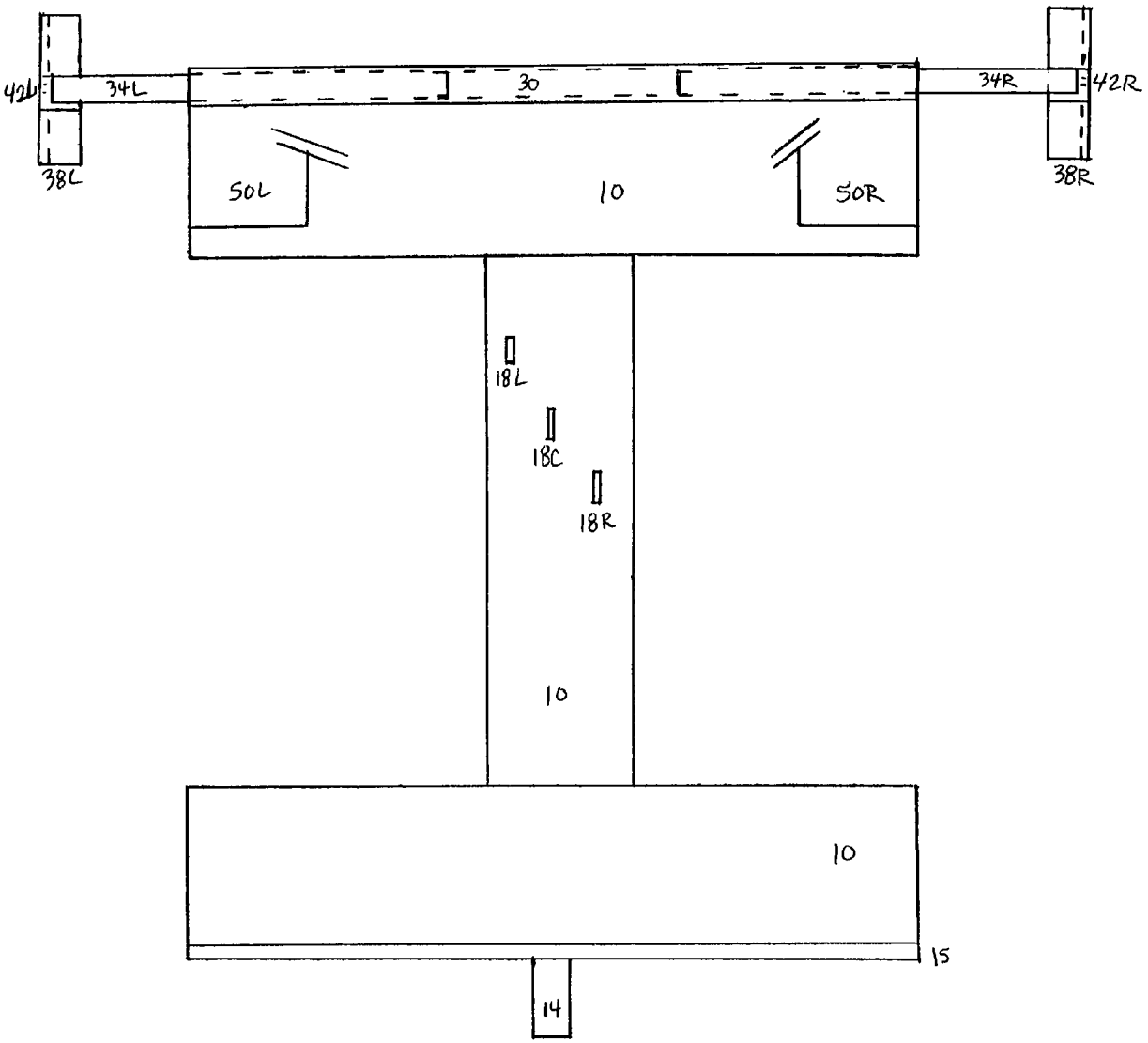
FIG. 6 is a top view excluding the base plate nuts and tile clamp bolts.

A clamp guide tube 30, a round pipe, is attached to the front of base plate 10 and extends the entire width of base plate 10. Clamp guide tube 30 houses two clamp guide rods 34R and 34L which are round and solid. Different size tiles can be accommodated because clamp guide rods 34R and 34L can be extended to varying widths and they move freely within clamp guide tube 30. See FIGS. 5, 6 for illustration. At the outward end of clamp guide rod 34R is attached a tile clamp 38R and a tile clamp riser 42R. At the outward end of clamp guide rod 34L is attached a tile clamp 38L and a tile clamp riser 42L. Tile clamp riser 42R and 42L are attached vertically and perpendicular to tile clamp 38R and 38L respectively. Tile clamps 38R and 38L, and tile clamp riser 42R and 42L can be made of different shaped materials and one that is shown is angle iron as in FIGS. 1, 7.

A tile clamp bolt 48R and a tile clamp bolt 48L are interchangeable depending which side the user wants to make hand adjustments. In FIG. 1 tile clamp bolt 48R has the handle to be used to tighten and loosen the apparatus from tile 54, and tile clamp bolt 48L is used as a width setting guide needing adjustment only when a different size tile is encountered. Tile clamp bolt 48R fits through a hole in tile clamp riser 42R and bolts to width adjustment nut 46R. Tile clamp bolt 48L fits through a hole in tile clamp riser 42L and bolts to width adjustment nut 46L. Width adjustment nut 46R is supported above clamp guide tube 30 by a width adjustment nut support 50R. Width adjustment nut 46L is supported above clamp guide tube 30 by a width adjustment nut support 50L. The width-clamping action supports the apparatus along both sides of tile 54 where clamps 38R and 38L contact tile 54.

Some differences are illustrated in an alternate embodiment shown in FIGS. 3, 7*a*. Base plate 10 is two separate pieces, a base plate 10A and a base plate 10B, and is held together by an adjustment plate 58. Base plate 10A is secured to adjustment plate 58 by an adjustment bolt 62A and a length adjustment nut 66A. Base plate 10B is secured to adjustment plate 58 by an adjustment bolt 62B and a length adjustment nut 66B. This set up allows for changing the length of the apparatus to fit various situations or different sized tile by loosening length adjustment nuts 66A and 66B, changing the to the length, then tightening length adjustment nuts 66A and 66B.

In FIG. 3 spring lug 18L is set further back because it would interfere with some of the other components of the apparatus. In the case of the embodiment illustrated in FIG. 3 spring lugs 18C and 18R can be eliminated. In their place a different spring 22 can be used to change the tension required for the different sized tile.

Tile clamps 38R and 38L, and tile clamp risers 42R and 42L can be made of differently shaped materials and another one shown in FIGS. 3, 7*a* is flat bar.

A tile clamp bolt 48R and a tile clamp bolt 48L are interchangeable depending which side the user wants to make hand adjustments. Tile clamp bolt 48R fits through a hole in tile clamp riser 42R and bolts to width adjustment nut 46R. Tile clamp bolt 48L fits through a hole in tile clamp riser 42L and bolts to width adjustment nut 46L. Width adjustment nut 46R is supported above clamp guide tube 30 by a width-adjustment nut support 50R. Width adjustment nut 46L is supported above clamp guide tube 30 by a width-adjustment nut support 50L. Lock nut 70R attaches tile clamp bolt 48R to clamp riser 42R because the bolt head is on the inside of base plate 10A. Lock nut 70L attaches tile clamp bolt 48L to clamp riser 42L because the bolt head is on the inside of base plate 10A. The width-clamping action secures the apparatus along both sides of tile 54 where clamps 38R and 38L contact tile 54. See FIGS. 3, 7*a* for illustration.

Another embodiment illustrated in FIGS. 8 and 9 is simpler in comparison to previous embodiments. Base plate 10 is "I" shaped like previous embodiments however; base tang 14 is placed beneath the main beam of base plate 10. Base tang 14 consists of a coupling nut and a bolt which can be replaced when worn. Width adjustment nuts 46R and 46L are mounted to the front of base plate 10. Tile clamp bolts 48R and 48L attach tile clamps 38R and 38L to base plate 10. Tile clamps 38R and 38L consist of a piece of pipe attached to an angled rigid material but can be made of a different shaped material. Their purpose is to support the apparatus during the removal process and do not necessarily need to be tightened on the tile. Tension clamp nut support 47 attaches tension clamp nuts 46 RC and 46 LC to base plate 10. Tension clamp 26 consists of a piece angled rigid material with two pieces of pipe material attached to the top of the angled material but can be made of a different shaped material. Tension clamp bolts 48RC and 48LC attach tension clamp 26 to base plate 10. The primary tension that attaches the embodiment to tile 54 is done with tension clamp 26.

The embodiments shown in FIGS. 1 and 3 can also be constructed without elements 50L, 50R, 48R, 48L, 42R, 42L, 46R, and 46L. Tile clamps 38R and 38L would support the apparatus as in the embodiment shown in FIG. 8 and tension clamp 26 would provide the tension to attach the apparatus to tile 54.

In all embodiments, an isolation membrane is placed between tile 54 and two of the apparatus contact areas—tension clamp 26, and base cleat 15.

As described above the apparatus allows tiles to be removed intact so that both the tile and the foundation surface can be prepared for resetting of the original tile. Multiple combinations of elements can be made to form the apparatus and the ones listed are examples of such combinations but should not be considered exhaustive.

OPERATION—FIGS. 1, 2, 4, 5, 6, 7

Prior to actual removal of a separated tile 54 from the foundation, the grout and any mortar surrounding this tile must be removed. The grout should be sawed out and not chipped out because hand chipping or using a mechanical chipping tool could damage the tile prior to its removal. Grout removal is complete when the underlying foundation can be seen in the space between the tiles. One reason that complete vacancy of the space is essential is because during the hammering and actual tile removal process, the tile moves forward as it breaks loose from its mortar bed and needs the space to move. Another reason is that the apparatus needs adequate space so that a base cleat clamp 15, a tile clamp 38R and a tile clamp 38L can fit into this space unencumbered and the apparatus will sit full depth.

After the grout has been properly removed from around tile 54, the apparatus is placed over it and base cleat 15, tile clamp 38R and 38L are fit into the appropriate spaces around tile 54. Before the apparatus is secured to tile 54 an isolation membrane is put between the edge of tile 54 and tension clamp 26, and between the edge of tile 54 and base cleat clamp 15. The width between the clamps is adjusted by screwing in or out a tile clamp bolt 48R and a tile clamp bolt 48L. Tension to tile 54 can be provided through tile clamps 38R and 38L through tile clamp bolts 48R and 48L.

Tension clamp 26 provides the tension between the apparatus and tile 54 in all embodiments. The clamping action between tension clamp 26 and base cleat clamp 15 should be such that the apparatus is immobilized on tile 54.

After the apparatus has been set in place and the tile clamps 38R and 38L and base cleat clamp 15 are correctly set in the grout spaces the tile should be somewhat centered over the tile 54. Once the tension is set between the tension clamp 26 and base cleat clamp 15 the apparatus should be secure enough so that it does not move and feels solid on tile 54. If needed tension can be applied to tile clamps 38R and 38L. The apparatus is then ready to start removal of tile 54.

A base tang 14 is then struck several times until the tile moves forward. At this point no further hammering is needed and the tile can be lifted from its spot. Do not use a light weight hammer or sledge hammer for the job. Only enough power in the blow to base tang 14 to break the seal is needed. An excess of power will damage tile 54 and an insufficient amount of power will not jar tile 54 loose.

After tile 54 is removed, both the tile and the foundation must then be cleaned of old mortar. The tile can then be reset in the existing place or moved to a different room depending on the need.

Another embodiment is shown in FIGS. 3, 7*a*. Tile clamp bolts 48R and 48L are now adjusted on the inside portion of the apparatus instead of on the outside as in the operation above. Also the apparatus can be adjusted lengthwise through the use of an adjustment plate 58 that attaches a base plate 10A and to a base plate 10B. Once the correct length is set then a length adjustment nut 66A and a length adjustment nut 66B are tightened. The rest of the removal process is the same as the above embodiment.

Another embodiment shown in FIGS. 8 and 9 use fewer parts than the previous embodiments but is set up the same. The difference is that tension on tension clamp 26 is done through a bolt and nut mechanism. Tile clamps 38R and 38L can be tightened on tile 54 if needed. The rest of removal process is the same.

SUMMARY, RAMIFICATIONS, AND SCOPE

Accordingly, the user of the apparatus can reset a separated tile because the original tile can be recovered intact thereby keeping the floor whole and uniform. This is an improvement over the existing method of repair, namely destructive removal and replacement with new tile, and is a viable alternative to adhesive injection. The apparatus provides for cost savings to the consumer because no new tiles are needed and only those tiles that are separated need repairing. The apparatus can also remove fully set tiles to be used in another room as needed.

Thus the scope of the apparatus should be determined by the appended claims and their legal equivalents, rather than by the examples given.

I claim:

1. A method for removing a portion of a grouted tile floor from the foundation comprising the steps of:

a. removing grout and cementitious material around all sides of said tile without damaging said tile;

b. securing an apparatus to said tile, the apparatus comprising a rigid material forming a base plate of a predetermined size; a plurality of clamps that secure said base plate to said tile that fit into evacuated grout spaces around said tile; a cleat clamp attached to said base plate that fits into another evacuated grout space opposite to a tensioning clamp, and; an impact area on said cleat clamp and base plate for a hammering force to be applied on said impact area used to drive said base plate and consequently said tile forward in the same direction of the impact force;

c. impacting the impact area to drive the tile forward.

2. The method of claim 1, wherein removing said grout around said tile is done using a circular abrasive blade saw to cut out said grout or a drill to bore multiple holes in a series in said grout.

3. The method of claim 1 wherein said plurality of clamps is a minimum of two clamps that sandwich said tile.

4. The method of claim 1 wherein said clamps which sandwich said tile use a tensioning means to control the pressure exerted on said tile by said clamps.

5. The method of claim 1 wherein said base plate is secured to said tile on the side opposite said impact area through a tensioning means.

6. An apparatus for removing a grouted floor tile comprising:

a. a means for removing grout and cementing material around all sides of said tile without damaging said tile;

b. a rigid material forming a base plate of a predetermined size;

c. a plurality of clamps that secure the base plate to said tile that are dimensioned to fit into evacuated grout spaces around said tile;

d. a cleat clamp attached to said base plate that is dimensioned to fit into another evacuated grout space opposite to said tensioning clamp to grip said edge of the tile; and, e. an impact area on said base plate for a hammering force to be used to drive said base plate and consequently said tile forward.

7. The apparatus of claim 6; wherein the means for removing said grout around said tile is a circular abrasive blade saw or a drill.

8. The apparatus of claim 6 wherein said clamps sandwich said tile use a tensioning means to control the pressure exerted on said tile by said clamps.

9. The apparatus of claim 6 wherein said base plate is secured to said tile on the side opposite of said impact area through a tensioning means.

10. The apparatus of claim 6 wherein said plurality of clamps is a minimum of two clamps that sandwich said tile.

* * * * *